US010514147B2

(12) United States Patent
Kim

(10) Patent No.: US 10,514,147 B2
(45) Date of Patent: Dec. 24, 2019

(54) HEADLIGHT MODULE HAVING THIN PLATE TYPE METAL PCB

(71) Applicant: ECOCAB.CO., LTD, Ulsan (KR)

(72) Inventor: Chang-Won Kim, Busan (KR)

(73) Assignee: ECOCAB.CO., LTD, Ulsan (KR)

( * ) Notice: Subject to any disclaimer, the term of this patent is extended or adjusted under 35 U.S.C. 154(b) by 0 days.

(21) Appl. No.: 16/515,671

(22) Filed: Jul. 18, 2019

(65) Prior Publication Data

US 2019/0338910 A1 Nov. 7, 2019

Related U.S. Application Data

(62) Division of application No. 15/745,343, filed as application No. PCT/KR2016/014388 on Dec. 8, 2016.

(30) Foreign Application Priority Data

Nov. 7, 2016 (KR) ..... 10-2016-0147368

(51) Int. Cl.

| | |
|---|---|
| ***F21V 21/00*** | (2006.01) |
| ***F21S 45/47*** | (2018.01) |
| ***F21V 29/89*** | (2015.01) |
| ***F21S 41/151*** | (2018.01) |
| ***F21S 41/141*** | (2018.01) |
| ***F21V 19/00*** | (2006.01) |
| *F21Y 115/10* | (2016.01) |

(52) U.S. Cl.

CPC ..... *F21S 45/47* (2018.01); *F21S 41/141* (2018.01); *F21S 41/151* (2018.01); *F21V 19/004* (2013.01); *F21V 29/89* (2015.01); *F21Y 2115/10* (2016.08)

(58) Field of Classification Search

CPC ..... F21S 41/141; F21S 41/151; F21S 41/153; F21S 45/47; F21V 19/004; F21V 19/47; F21V 29/89

USPC ..... 362/249.02, 543–545

See application file for complete search history.

(56) References Cited

FOREIGN PATENT DOCUMENTS

| | | |
|---|---|---|
| JP | 2008-311190 A | 12/2008 |
| JP | 2013-232305 A | 11/2013 |
| KR | 10-1589017 B1 | 1/2016 |

*Primary Examiner* — Jason M Han

(74) *Attorney, Agent, or Firm* — Novick, Kim & Lee, PLLC; Jae Youn Kim

(57) ABSTRACT

Provided is a headlight module having a thin plate type metal PCB, wherein the headlight module has the assembly structure of a metal PCB formed of a thin plate which is a thermal conductor and capable of being bent in various directions and including at least one protruded portion increasing a surface area on both sides, and a back plate coupled to the metal PCB through the protruded portion.

1 Claim, 9 Drawing Sheets

HEADLIGHT MODULE HAVING THIN PLATE TYPE METAL PCB

CROSS-REFERENCE TO RELATED APPLICATIONS

This application is a divisional application of U.S. application Ser. No. 15/745,343 filed on Jan. 16, 2018, which is a national-stage application of international application No. PCT/KR2016/014388 filed on Dec. 8, 2016, and claims priority under 35 USC § 119 to the Korean patent application No. 10-2016-0147368 filed on Nov. 7, 2016, the entire disclosures of which are incorporated herein by reference in their entirety.

BACKGROUND OF THE INVENTION

Technical Field

The present invention relates to a headlight module having a thin plate type metal PCB, wherein the headlight module has the assembly structure of a metal PCB formed of a thin plate which is a thermal conductor and capable of being bent in various directions and including at least one protruded portion increasing a surface area on both sides, and a back plate coupled to the metal PCB through the protruded portion.

Description of Related Art

In general, the LED is chiefly used in the liquid crystal display device (LCD) of a mobile phone, an electronic display board, and a dashboard for a vehicle because it has low consumption power, has long lifespan and does not generate a contaminant, such as environment pollution.

As the LED recently has a wider application, it is applied to common lamps or the headlight of a vehicle in addition to the indoor light or signboard of a vehicle and the backlight unit (BLU) of an LCD device.

In particular, an LED lamp module (M) applied to the headlight of a vehicle is configured to include a reflector, for reflecting light generated by an LED, a board for controlling the mounted LED through the supply of power, a heat sink for externally discharging heat generated by the LED, and a back cover on which the heat sink is mounted.

Furthermore, there was pointed out that a board used for various parts in addition to the LED has a low heat-dissipation effect. In order to solve this problem, a metal board adopting metal materials, such as aluminum or a copper alloy, (hereinafter a metal board) has been in the spotlight in the market.

In particular, recently, in relation to the demands for a metal board on which an LED is mounted, there emerges a demand for a metal board on which an LED is mounted which is capable of being mechanically formed, such as curving or pressing.

The technology of a conventional metal PCB assembly for a vehicle lamp related to such a technology is proposed in Korean Patent No. 1589017. In its configuration, as in FIG. 1, the metal PCB assembly 10 for a vehicle lamp includes a metal PCB 14; at least one unit pattern (not shown) disposed on the metal PCB 14, having three surfaces cut and one surface connected to the metal PCB 14, and protruded from the metal PCB 14 at a specific angle in the inclined state; and a projected matter coupled to the metal PCB 14 and enabling a support part protruded toward a horizontal surface to support the unit pattern and maintain a specific angle. The assembly of the metal PCB 14 includes a curved groove 24 of a specific depth formed at the bottom of the metal board 22 and bends each unit pattern on which each LED is mounted by forward pushing the unit pattern based on the curved groove, thereby fabricating the metal PCB assembly 10 having a stepped shape with a small power.

In this case, the external three surfaces 20*a*, 20*b* and 20*c* of the unit pattern are also cut. Since one surface 20*d* of the unit pattern has been integrated and connected to the metal PCB 14, the unit pattern is not fully separated from the metal PCB 14 and is inclined at a specific angle and protruded with one side connected to the metal PCB 14.

However, the metal PCB assembly for a vehicle lamp has problems in that a work process is increased because the curved groove of a specific depth must be formed at the bottom of the metal board so as to form the unit pattern and the metal board is broken upon bending.

SUMMARY OF THE INVENTION

An object of the present invention for improving the conventional problems is to provide a headlight module having a thin plate type metal PCB, which can be applied to various shapes while maximizing a heat-dissipation effect, can reduce a production cost and workers by simplifying the process, can reduce a development cost and period by simplifying the structure of a back plate, and can minimize an error rate upon assembly by simplifying the structure.

In order to achieve the object, the present invention provides a headlight module having a thin plate type metal PCB, wherein the headlight module has the assembly structure of a metal PCB formed of a thin plate which is a thermal conductor and capable of being bent in various directions and including at least one protruded portion increasing a surface area on both sides, and a back plate coupled to the metal PCB through the protruded portion.

In addition, the present invention provides a headlight module having a thin plate type metal PCB in which the metal PCB includes a plurality of chip mounting parts in a base, and the chip mounting parts are disposed in parallel or directed in the same direction by the relative bending of any one of the base and the chip mounting parts.

Furthermore, the present invention provides a headlight module having a thin plate type metal PCB, wherein the metal PCB is integrated with a plurality of protruded portions formed of an aluminum thin plate and maintaining the same interval in a width direction.

Thereafter, the present invention provides a headlight module having a thin plate type metal PCB, wherein the back plate is integrated with a plurality of contact support jaws formed in accordance with the base or the chip mounting parts in such a way as to correspond to the tilt of the chip mounting pats.

In addition, the present invention provides a headlight module having a thin plate type metal PCB, wherein the back plate is inclined to have a width reduced from the top to the bottom, and the back plate is disposed so that the protruded portion is pressed and closely attached to the back plate.

Furthermore, the present invention provides a headlight module having a thin plate type metal PCB, wherein the back plate includes a latching ring to which an elastic support plate provided in the protruded portion is fixed.

Thereafter, the present invention provides a headlight module having a thin plate type metal PCB, wherein the metal PCB includes an exploded groove having one surface connected to a base and open or shut in the periphery of the base.

Furthermore, the present invention provides a headlight module having a thin plate type metal PCB, wherein the metal PCB is disposed so that the at least one protruded portion is bent in the form of the latching ring and a fixed jaw provided in the back plate is coupled to the at least one protruded portion.

Furthermore, the present invention provides a headlight module having a thin plate type metal PCB, wherein the back plate has an inclined surface at a top so that the protruded portion is pressed and fixed to the inclined surface and is integrated with a latching hook integrated with a support groove engaged and supported by the protruded portion.

As described above, the present invention has effects in that it can be applied to various shapes while maximizing a heat-dissipation effect, can reduce a production cost and workers by simplifying the process, can reduce a development cost and period by simplifying the structure of a back plate, and can minimize an error rate upon assembly by simplifying the structure.

DETAILED DESCRIPTION

Figure 1:
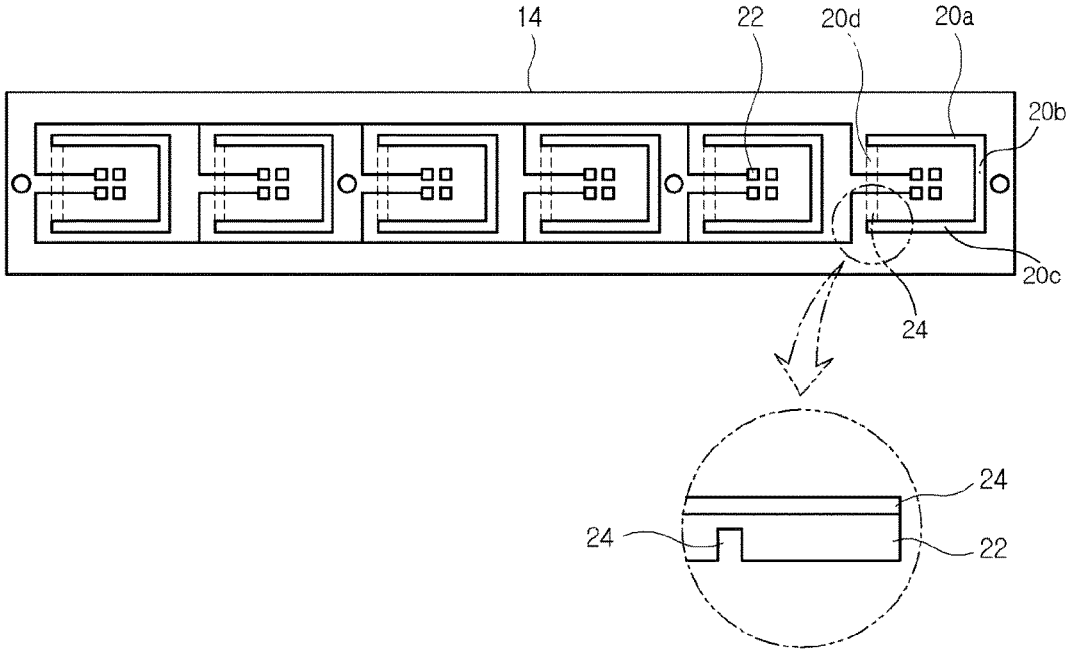
FIG. 1 is an exploded view showing a conventional LED lamp module.
Figure 2:
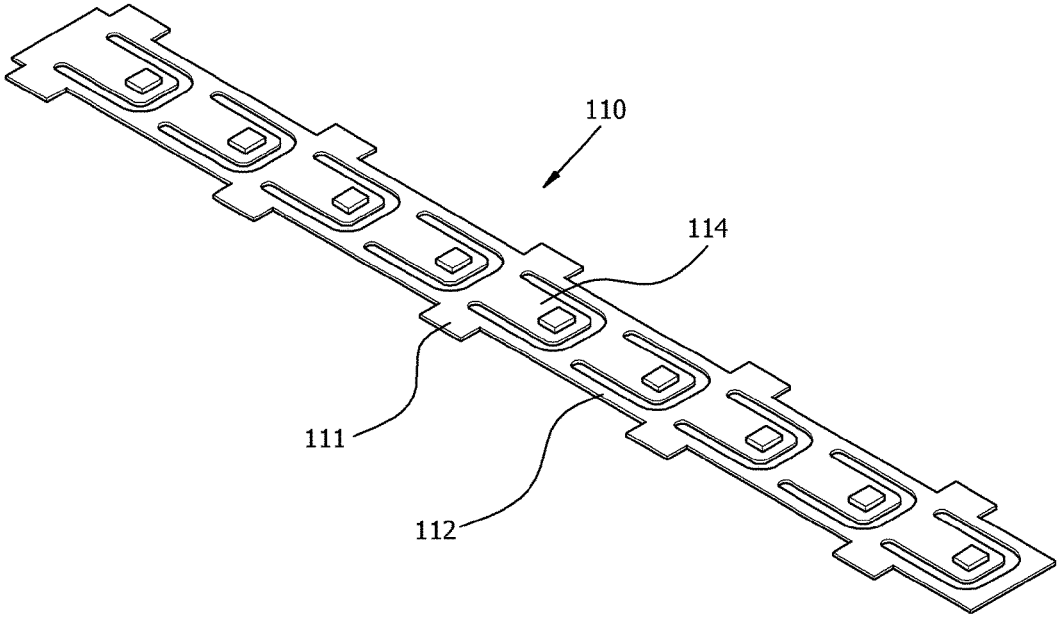
FIGS. 2 to 4 are perspective views showing the bent state of a metal PCB according to the present invention.

Hereinafter, embodiments of the present invention are described in detail with reference to the accompanying drawings.

A headlight module of the present invention has the assembly structure of a metal PCB 110 and a back plate 150.

Furthermore, the metal PCB 110 is equipped with at least one protruded portion 111 formed of a thin plate which is a thermal conductor, can be bent, and increases a surface area in order to supplement a reduction of the volume attributable to a reduction in the thickness on both sides.

In this case, the protruded portion 111 is formed in various shapes for coupling with the back plate 150.

Furthermore, the back plate 150 is integrated with a support surface 151 having a stepped or inclined shape for close coupling with the metal PCB on the upper side and is integrated with a mounting portion 153 mounted in accordance with a lamp housing on the bottom surface.

In addition, the metal PCB 110 includes a plurality of chip mounting parts 114 in a base 112.

Figure 3:
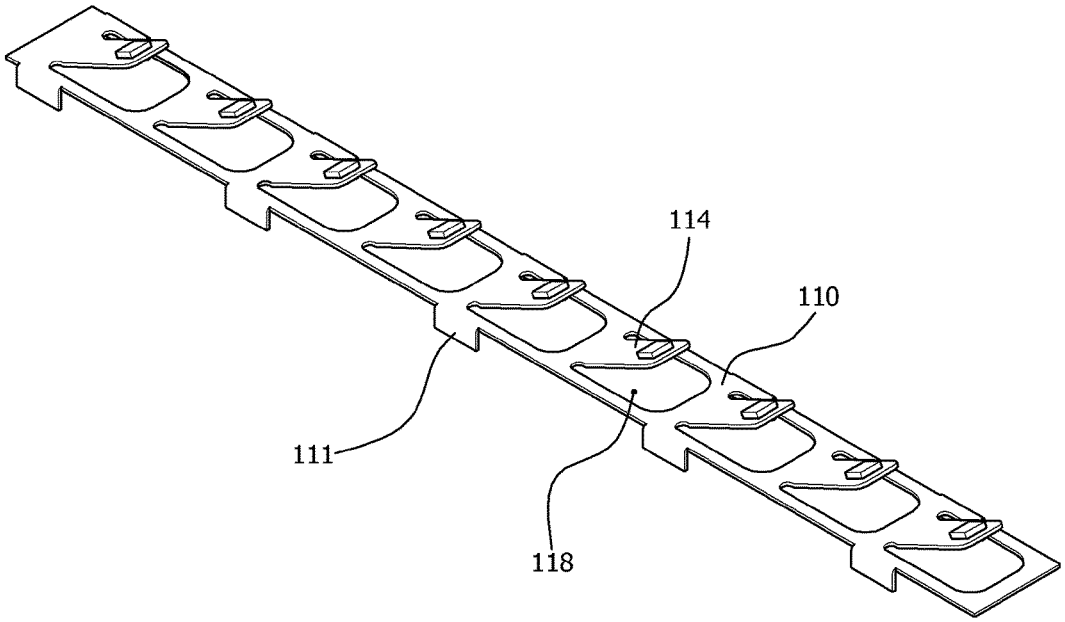
Figure 4:
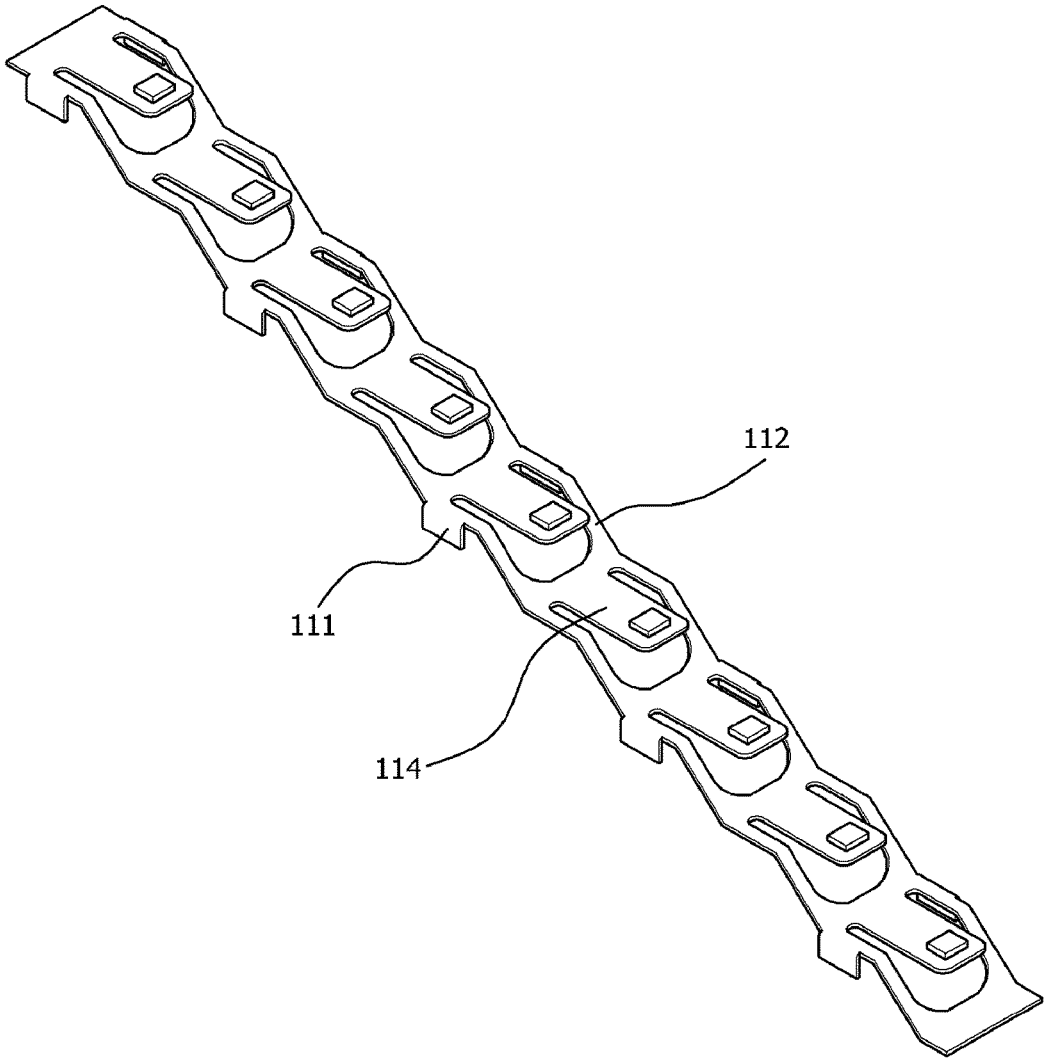

In this case, as in FIGS. 3 and 4, the plurality of chip mounting parts is disposed to be directed toward the same direction in the metal PCB 110 by relative bending in which the base 112 is bent or the chip mounting parts 114 are bent.

Furthermore, the metal PCB is formed of a sheet made of aluminum or a sheet made of copper and is also made of a thin plate.

In this case, the protruded portions 111 may be disposed at the same interval in the length direction of the metal PCB in the width direction.

Thereafter, the back plate 150 is integrated with a plurality of contact support jaws 158 on the top surface so that they corresponds to the inclination of the chip mounting parts while they are formed to correspond to the base or the mounting portion.

Figure 5:
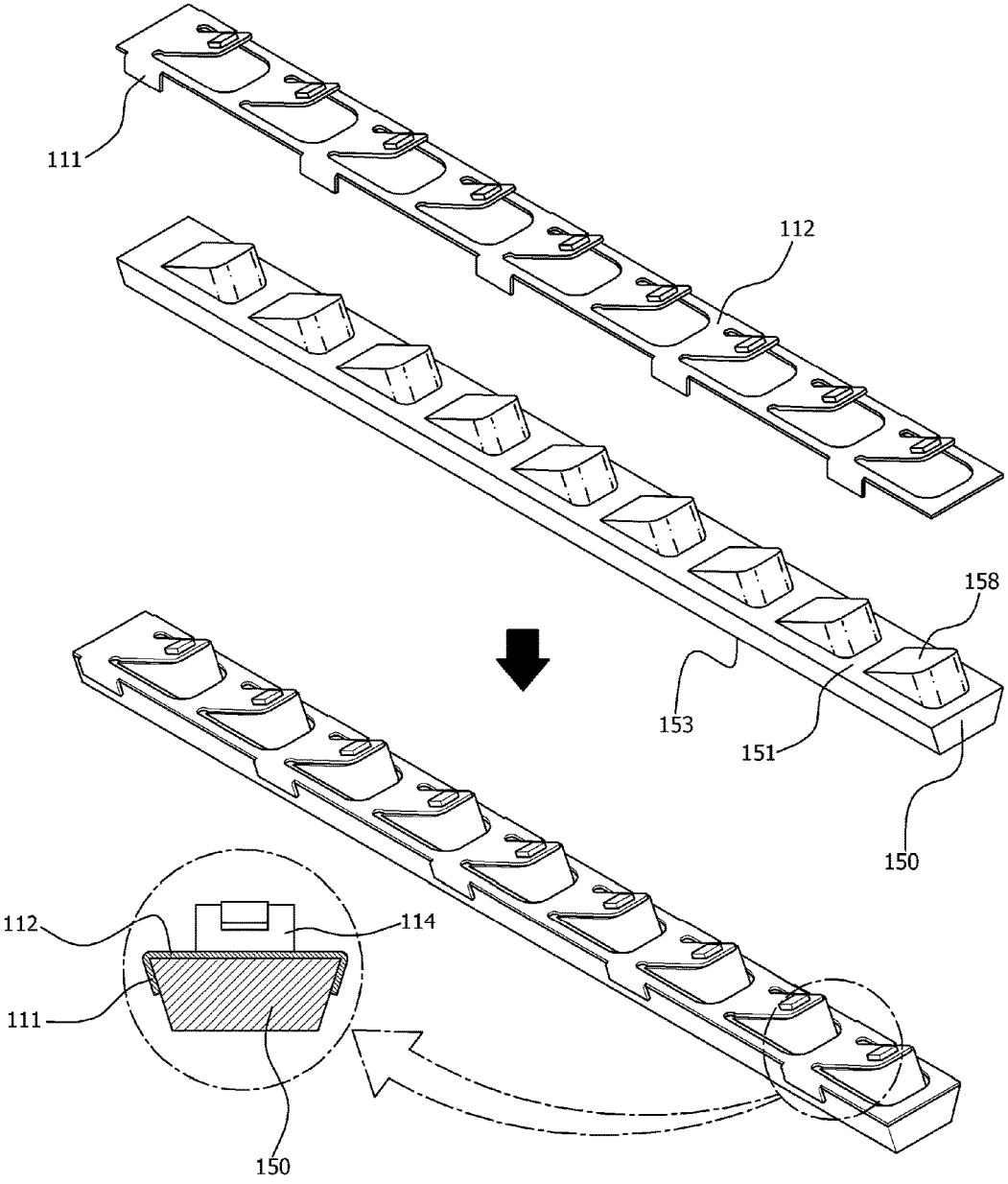
FIG. 5 is a perspective view showing the coupling state of the metal PCB and the back plate according to the present invention.

In addition, as in FIG. 5, the back plate 150 is inclined to have a width reduced from the top to the bottom. The protruded portion may be pressed in the back plate to closely fix the metal PCB to the back plate.

Furthermore, the back plate 150 includes a latching ring 155 of a ring shape so that an elastic support plate 111*a* provided in the protruded portion 111 is fixed to the latching ring 155.

Thereafter, the metal PCB 110 is equipped with an exploded groove 118 which has one surface connected to the base 112 and is open or shut in the periphery of the base when the mounting portion is formed.

Figure 6:
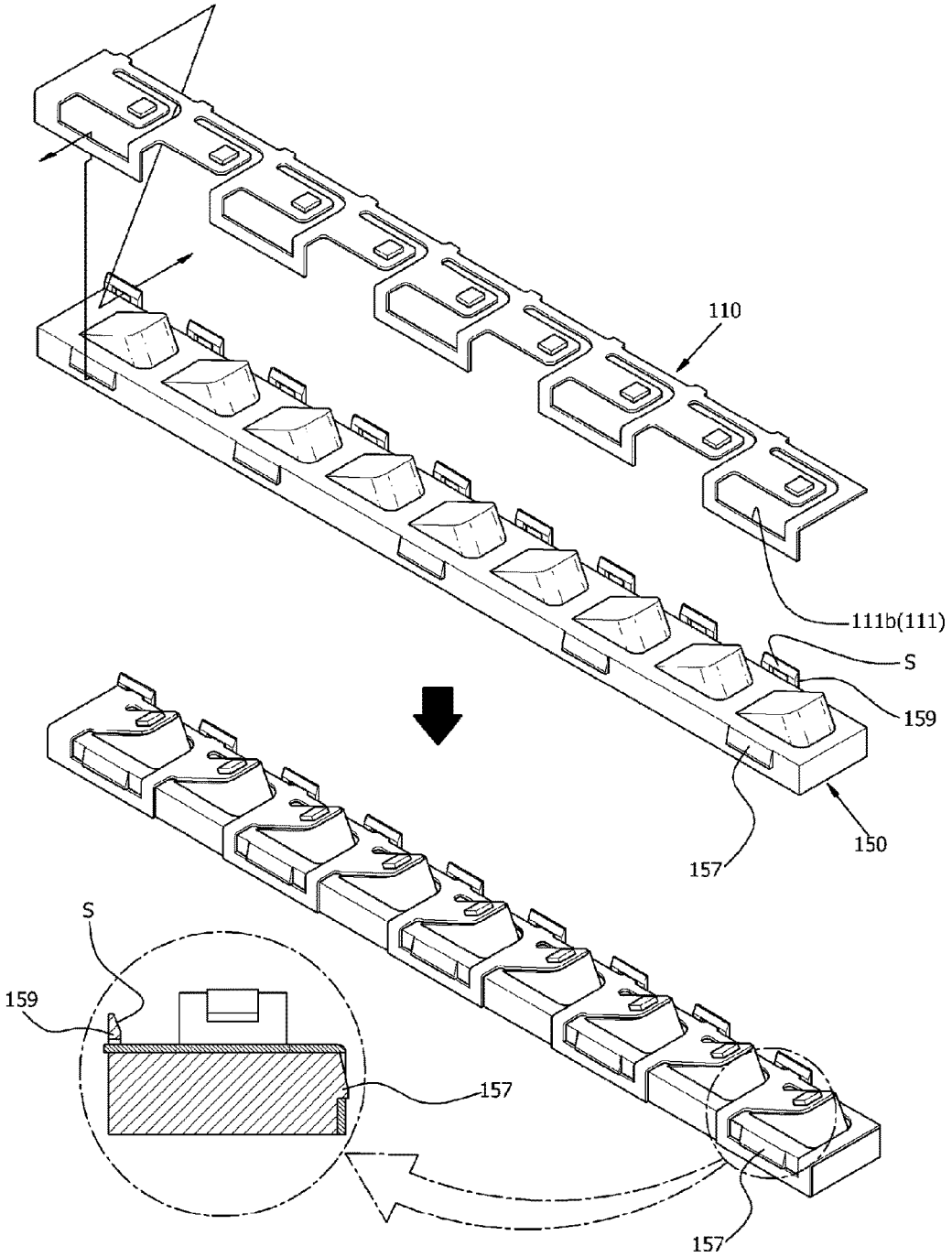
FIGS. 6 to 9 are perspective views showing the coupling state of the metal PCB and the back plate according to other embodiments of the present invention.

Furthermore, as in FIG. 6, in the metal PCB 110, the at least one protruded portion may be bent in the form of a latching ring 111*b* so that a fixed jaw 157 provided in the back plate is coupled to the latching ring 111*b*.

Furthermore, the back plate 150 may have a configuration integrated with a latching hook 159 having an inclined surface S at the top so that the protruded portion is pressed in the latching hook 159 and fixed thereto.

Although the embodiments of the present invention have been described in detail, the range of right of the present invention is not limited thereto, and a person having ordinary skill in the art will evidently understand that the present invention may be changed and modified in various ways without departing from the technical spirit of the present invention written in the claims.

DETAILED DESCRIPTION OF DISCLOSURE

An operation of the present invention having such a configuration is described.

As shown in FIGS. 2 to 9, the headlight module of the present invention has the assembly structure the metal PCB 110 and the back plate 150.

Furthermore, the metal PCB 110 is formed of a thin plate which is a thermal conductor and can be bent so that it can be easily bent in various directions.

In addition, the metal PCB 110 solves a reduction of the volume attributable to a reduction in the thickness through the at least one protruded portion 111 that increases a surface area on both sides, thereby enabling an implementation of a required heat-dissipation effect.

In this case, the metal PCB is easily coupled to the back plate 150 through the protruded portion 111 protruded for heat dissipation and a connection task.

Furthermore, the back plate 150 is integrated with the support surface 151 having a stepped or inclined shape at the top for the contact coupling of the metal PCB, and is integrated with the mounting portion 153 mounted in according to the lamp housing at the bottom. Accordingly, when the back plate is mounted on a lamp housing, a light source can be radiated in various directions. An LED chip (not shown) is mounted on the mounting portion.

In addition, in the metal PCB 110, the plurality of chip mounting parts 114 is provided in the base 112 so that the LED chips are integrated and mounted on the chip mounting parts, respectively.

In this case, as in FIGS. 3 and 4, in the metal PCB 110, the plurality of chip mounting parts 114 is disposed in parallel or in the same direction by relative bending between the base 112 and the chip mounting parts 114 so that the mounting portion is directed in a required direction.

Furthermore, the metal PCB is made of aluminum or copper and formed of a thin plate. Accordingly, the metal PCB is easily bent without damage to the thin plate.

In this case, the protruded portions 111 are disposed at the same interval in the length direction of the metal PCB in the width direction to maintain a generally uniform coupling force.

Thereafter, the back plate 150 is formed in accordance with the base or the mounting portion and is integrated with the plurality of contact support jaws 158 at the top in such a way as to correspond to the inclination of the mounting portion. Accordingly, when the metal PCB is mounted on the back plate, the mounting portion maintains an accurate tilt.

In addition, the back plate 150 is inclined to have a width reduced from the top to the bottom. When the protruded portion is bent and closely attached to the back plate, the metal PCB is closely fixed to the back plate.

Figure 9:
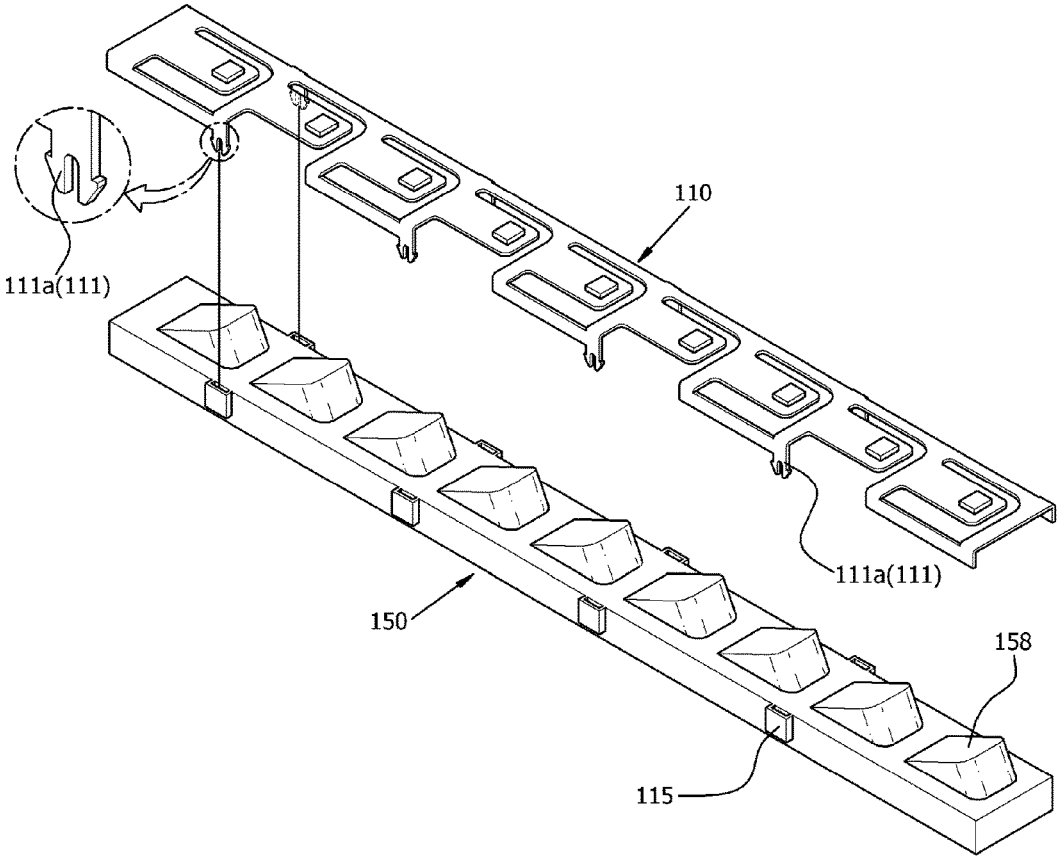

Furthermore, as in FIG. 9, the back plate 150 is equipped with the latching ring 115 of a ring shape so that the elastic support plate 111*a* provided in the protruded portion 111 is firmly fixed when the elastic support plate enters the latching ring 115 in a narrowed state and extends when it is pressed from the upper side.

Thereafter, the metal PCB 110 is equipped with the exploded groove 118 which has one surface connected to the base 111 and open or shut in its periphery when the mounting portion is formed, thereby enabling the tilt of the mounting portion to be easily adjusted.

Figure 7:
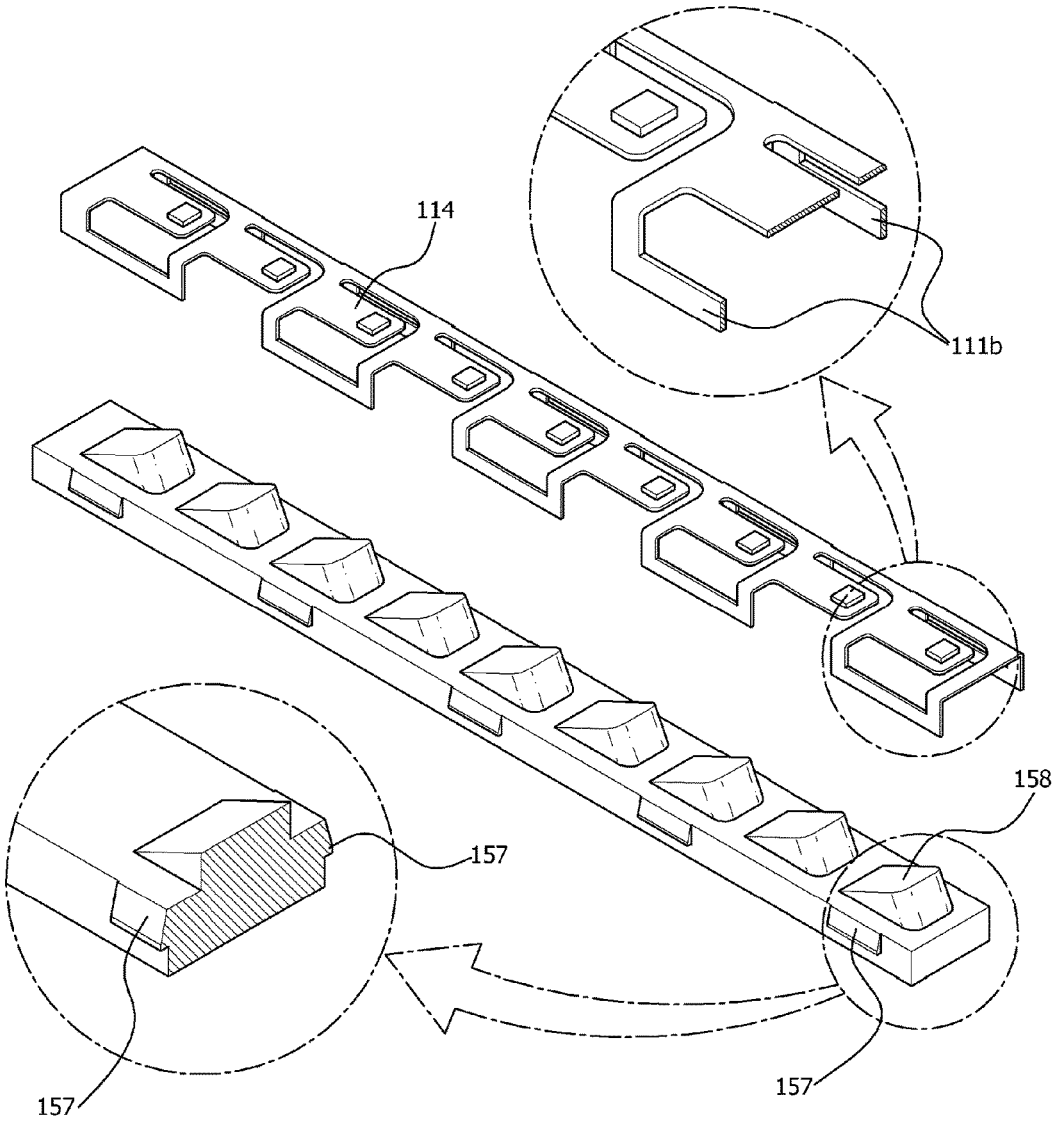
Figure 8:
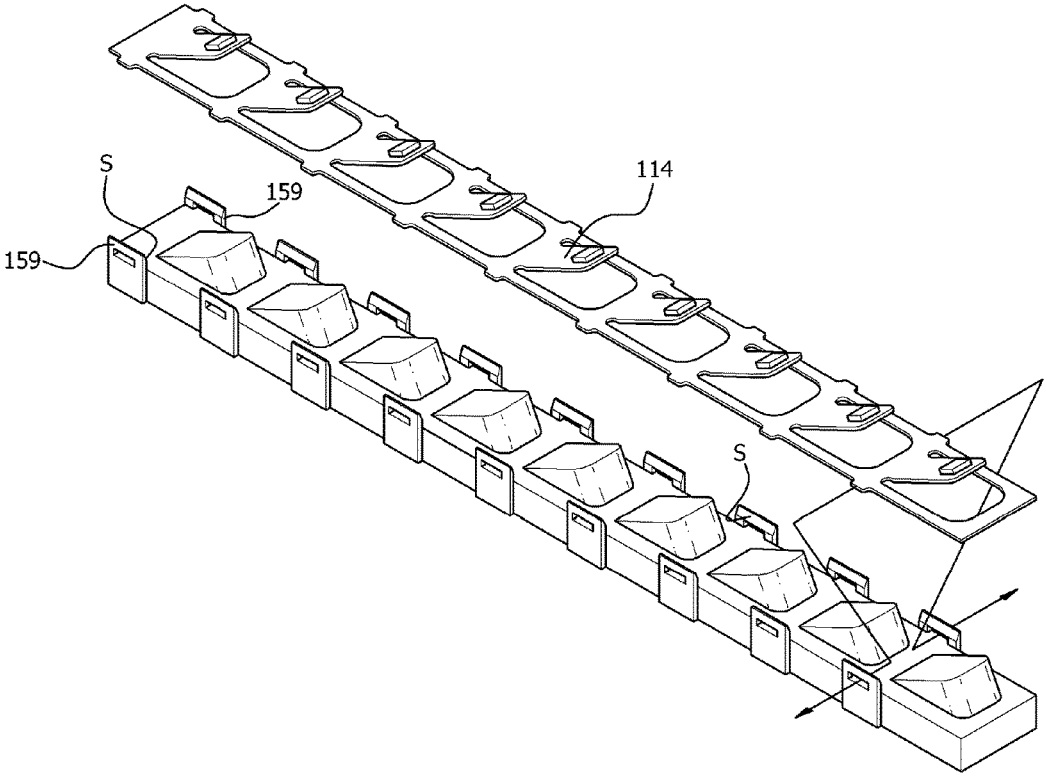

Furthermore, as in FIGS. 6 and 7, in the metal PCB 110, the at least one protruded portion is bent in the form of the latching ring 111*b* and the fixed jaw 157 provided in the back plate is coupled to the at least one protruded portion. Accordingly, the at least one protruded portion is coupled to the back plate by an operation of pressing the metal PCB from the top.

Furthermore, the back plate 150 is integrated with the latching hook 159 having the inclined surface S at the top so that the protruded portion is pressed and fixed thereto on the upper side.

That is, as described above, the present invention provides the configuration in which the protruded portion is fabricated in various shapes so that the protruded portion is coupled to the back plate without a separate tool. Accordingly, the coupling task of the metal PCB and the back plate can be rapidly performed.

The present invention relates to a headlight module having a thin plate type metal PCB, wherein the headlight module has the assembly structure of a metal PCB formed of a thin plate which is a thermal conductor and capable of being bent in various directions and including at least one protruded portion increasing a surface area on both sides, and a back plate coupled to the metal PCB through the protruded portion.

What is claimed is:

1. A headlight module comprising:

a metal PCB formed of a thin plate which is a thermal conductor and capable of being bent in various directions and has at least one protruded portion increasing a surface area on both sides; and a back plate coupled with the metal PCB through the at least one protruded portion, in such a way that the metal PCB is fixed to the back plate by being pressed at a top of the back plate, wherein the metal PCB comprises:

a) a plurality of chip mounting parts disposed in a base, the base and the chip mounting parts being mounted in parallel or directed in a same direction by a relative bending of any one of the base and the chip mounting parts, and b) an elastic support plate formed at one side of the base by the at least one protruded portion bent downwardly, and wherein the back plate comprises:

a) an upper surface formed to correspond to shapes of the base and the chip mounting parts, b) a plurality of contact support jaws formed integrally at one side to correspond to tilts of the chip mounting parts, and c) latching pieces, which are respectively formed at sides of the back plate, and, each of which has a fixing jaw and an inclined surface to correspond to the at least one protruded portion extending from the base and the elastic support plate bent downwardly, wherein the metal PCB and the back plate are formed in a stepped shape or an inclined shape.

* * * * *